US006186213B1

(12) United States Patent
Senesac

(10) Patent No.: US 6,186,213 B1
(45) Date of Patent: Feb. 13, 2001

(54) VERTICAL BLIND SYSTEM HAVING A REMOVABLE VANE COVER

(75) Inventor: Wayne M. Senesac, Oxford, IN (US)

(73) Assignee: Oxford House, Oxford, IN (US)

( * ) Notice: Under 35 U.S.C. 154(b), the term of this patent shall be extended for 0 days.

(21) Appl. No.: 09/286,911

(22) Filed: Apr. 6, 1999

(51) Int. Cl.[7] ..... E06B 9/26
(52) U.S. Cl. ..... 160/89; 160/84.04
(58) Field of Search ..... 160/89, 84.01, 160/84.04, 168.1 U, 176.1 U, 236, 348

(56) References Cited

U.S. PATENT DOCUMENTS

| | | | | |
|---|---|---|---|---|
| 2,874,772 | * | 2/1959 | Dwyer et al. | 160/348 |
| 3,106,240 | | 10/1963 | Weber | 160/196 |
| 3,844,330 | | 10/1974 | Hyman | 160/166 A |
| 3,851,699 | | 12/1974 | Shapiro | 160/166 |
| 4,049,038 | | 9/1977 | Hyman et al. | 160/166 A |
| 4,911,220 | | 3/1990 | Hiller | 160/236 |
| 5,012,552 | | 5/1991 | Wulf | 16/87.4 R |
| 5,249,617 | | 10/1993 | Dürig | 160/168.1 |
| 5,392,833 | | 2/1995 | Ohanesian | 160/89 |
| 5,439,042 | | 8/1995 | Ohanesian | 160/89 |
| 5,638,881 | | 6/1997 | Ruggles et al. | 160/168.1 |
| 5,713,407 | | 2/1998 | Judkins | 160/89 |
| 5,715,883 | | 2/1998 | Keith | 160/168.1 V |
| 5,749,404 | | 5/1998 | Colson | 160/84.04 |
| B1 4,049,038 | | 9/1989 | Hyman et al. | 160/166.1 |

* cited by examiner

*Primary Examiner*—Daniel P. Stodola
*Assistant Examiner*—Hugh B. Thompson
(74) *Attorney, Agent, or Firm*—Woodard, Emhardt, Naughton, Moriarty & McNett

(57) ABSTRACT

A vertical blind system includes a conventional vertical blind vane mechanism, a plurality of vertical blind vanes coupled to the vane mechanism, and a continuous blind vane cover, such as a white sheer fabric drapery material, removably mounted to several of the blind vanes with pairs of snap connectors connecting through holes near the top of each vane. This allows ready removal of the vane cover for washing, with ready replacement in the proper position after cleaning.

28 Claims, 4 Drawing Sheets

VERTICAL BLIND SYSTEM HAVING A REMOVABLE VANE COVER

BACKGROUND OF THE INVENTION

1. Field of the Invention

The present invention relates generally to the field of panel units having several vertical blind vanes. More particularly, the present invention relates to a cover in the nature of a curtain or drape removably mounted on an array of vertical blind vanes.

2. Background Art

A common covering system for a window is a vertical blind, having vertical vanes rotatable about vertical axes to an open or closed position. The covering system may further include a decorative cover mounted to the vertical blinds to thereby add esthetic qualities to the covering system. In some cases, the decorative cover may be removable from the blind vanes to enable a consumer to clean the removed decorative cover or to replace the removed decorative cover. A convenient mounting and dismounting of such removable decorative covers is therefore highly desired by consumers.

SUMMARY OF THE INVENTION

While the actual nature of the present invention can only be determined with reference to the claims appended hereto, certain of its features of one embodiment of the invention can be described briefly. A vertical blind system includes a conventional vertical blind vane mechanism. The blind vane mechanism provides rotational movements of the vertical vanes about vertical axes. Mechanisms can be used which either also provide traversing movement to the blind vanes, or which do not. Several vertical blind vanes are coupled to the vane mechanism, and a continuous blind vane cover is removably mounted near the top of each vane with pairs of connectors connecting through holes or with snaps attaching from opposite sides of each vane.

No limitations are contemplated as to a particular embodiment of the blind vane mechanism employed in a vertical blind system of the present invention, and any conventional mechanism can be used, provided vanes are adapted for use with connectors near their tops for mounting the blind vane cover of the invention as claimed below. The present invention further contemplates that the vertical blind vanes and the blind vane covers can have any configuration, can have any suitable dimensions, can be made from any suitable material, and may or may not be decorative. Consequently, the illustrations and accompanying description herein of the preferred embodiments of blind vanes, and blind vane covers are given solely for purposes of describing the best mode of the present invention and are not meant to be limiting as to the scope of the present invention in any way.

It is an object of the present invention to provide a vertical blind system having several vertical blind vanes and a blind vane cover that can be conveniently mounted to and dismounted from the blind vanes.

Related objects and advantages of the present invention will be apparent from the following description of the preferred embodiment.

DESCRIPTION OF THE PREFERRED EMBODIMENTS

Figure 1:
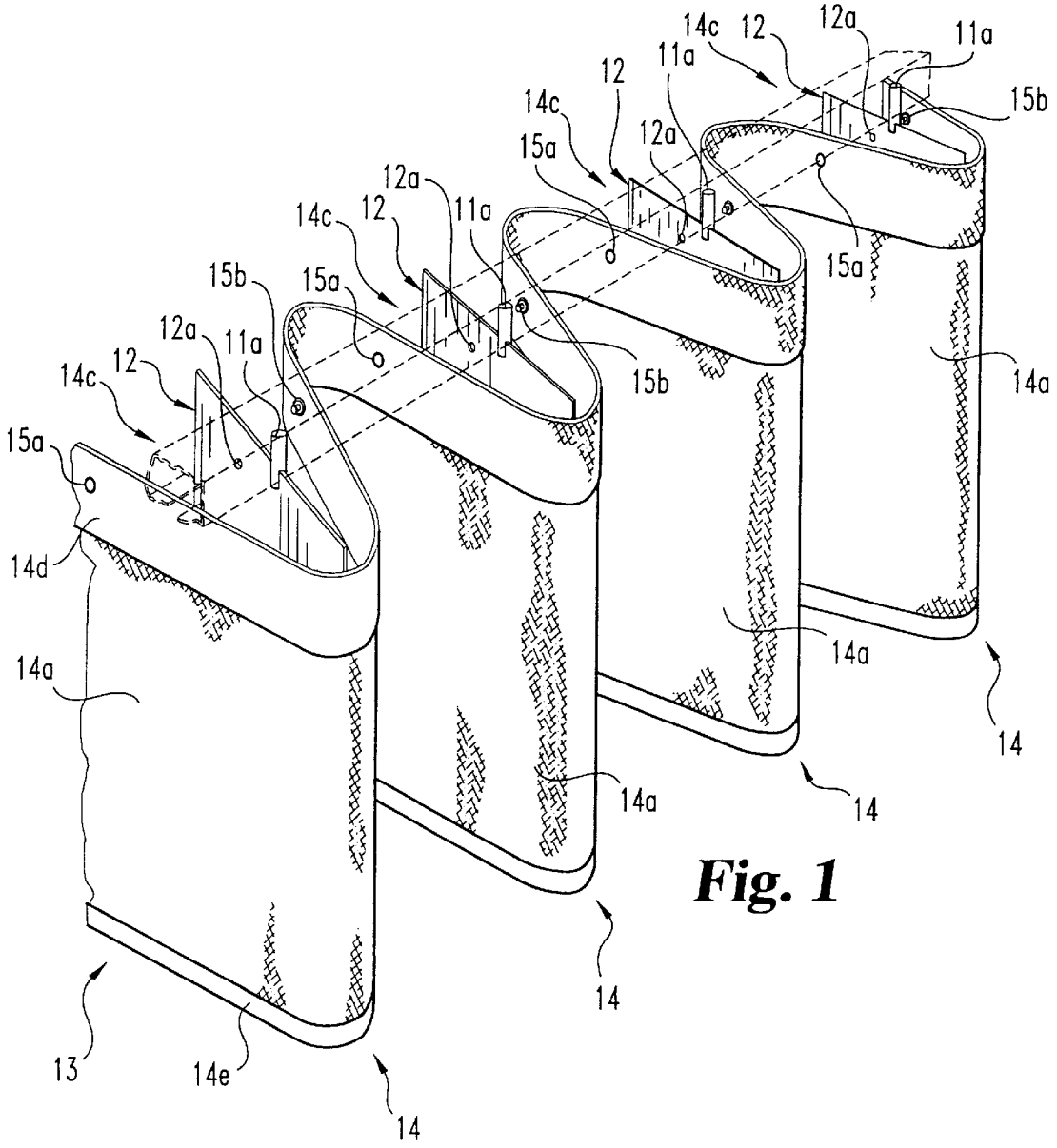
FIG. 1 is a fragmented upper left front perspective view of open vertical blind vanes and a blind vane cover dismounted therefrom, as is readily removable using the present invention.
Figure 2:
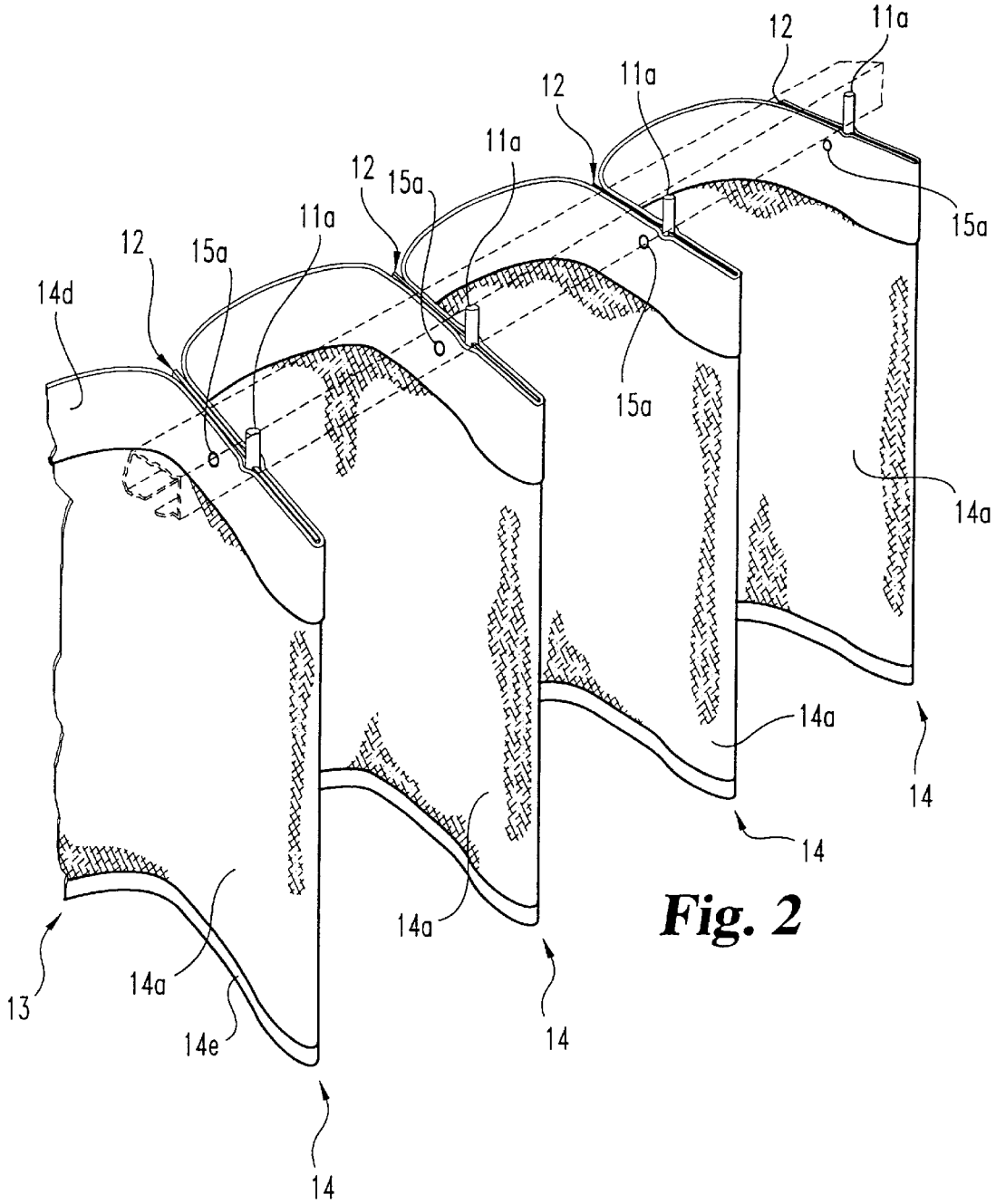
FIG. 2 is a fragmented upper left front perspective view of the blind vanes and cover of FIG. 1 mounted to the four (4) blind vanes of FIG. 1 in an open position.

For the purposes of promoting an understanding of the principles of the present invention, reference will now be made to the preferred embodiments of the present invention as illustrated in the drawings and specific language will be used to describe the same. It will nevertheless be understood that no limitation of the scope of the present invention is thereby intended. Any alterations and further modifications in the illustrated embodiments, and any further applications of the principles of the present invention as illustrated and described herein are contemplated as would normally occur to one skilled in the art to which the present invention relates.

Figure 3:
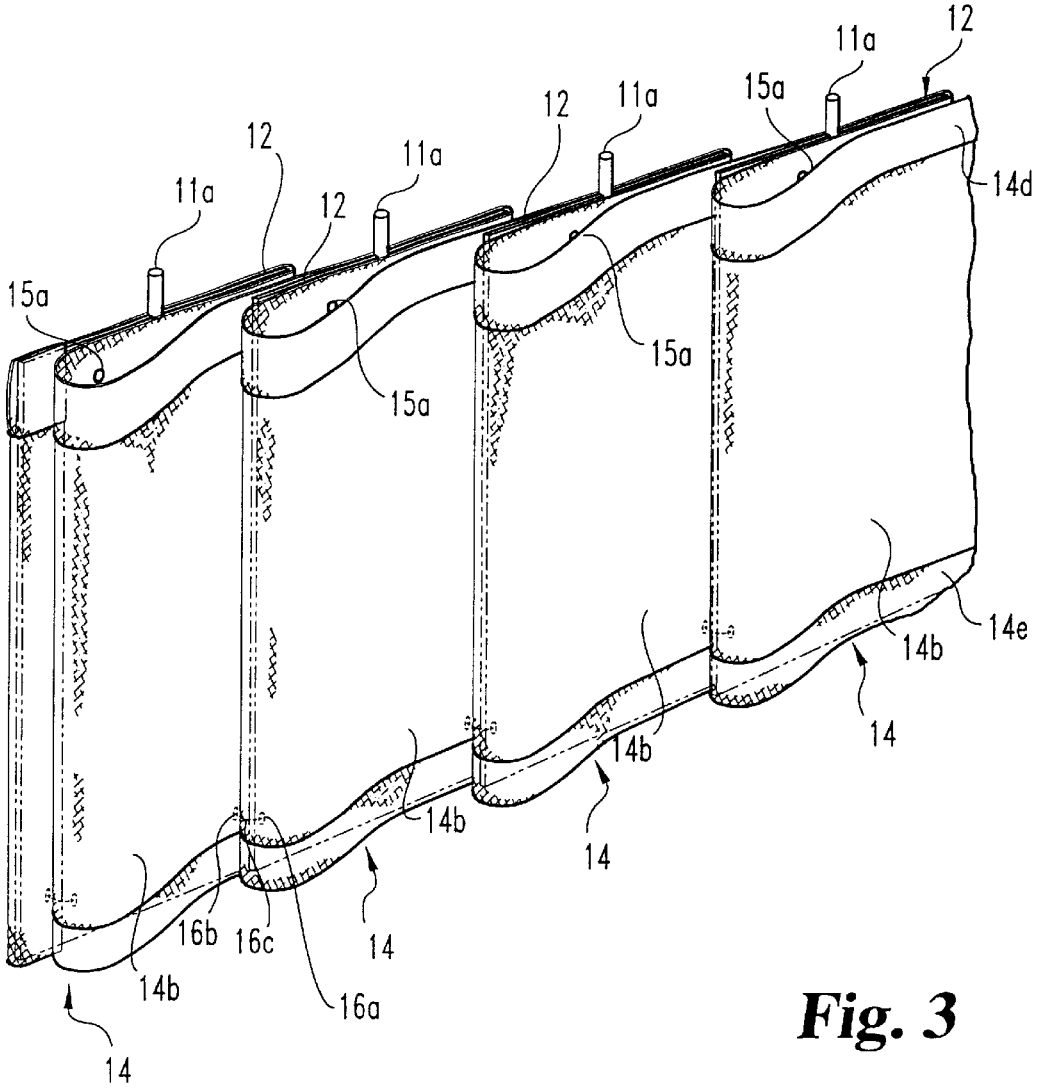
FIG. 3 is a fragmented upper right rear perspective view of the blind vanes and cover of FIG. 1 mounted to the four (4) blind vanes of FIG. 1 in a closed position.
Figure 4:
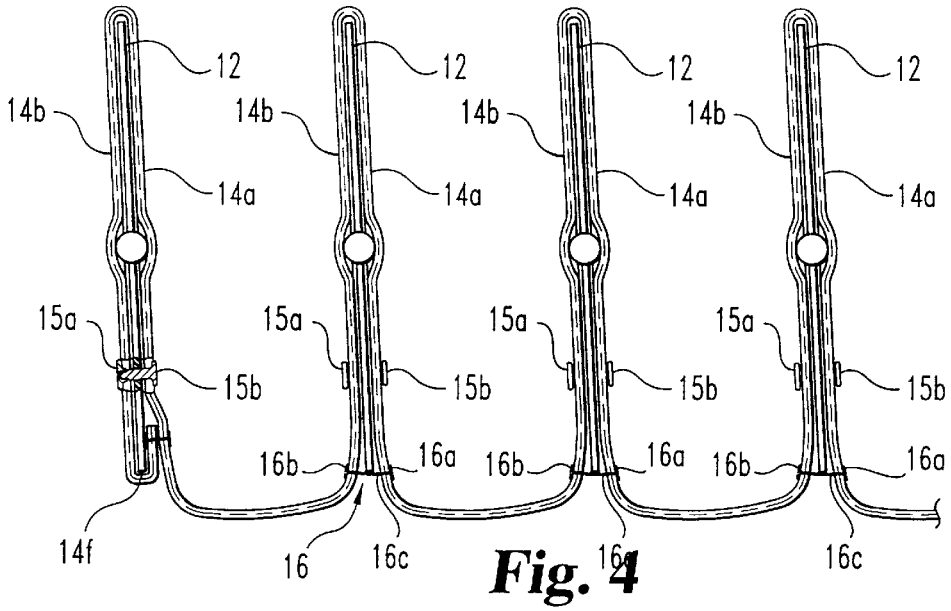
FIG. 4 is a fragmented top view of the blind vanes and cover of FIG. 1 mounted to the four (4) blind vanes of FIG. 1 in an open position.
Figure 5:
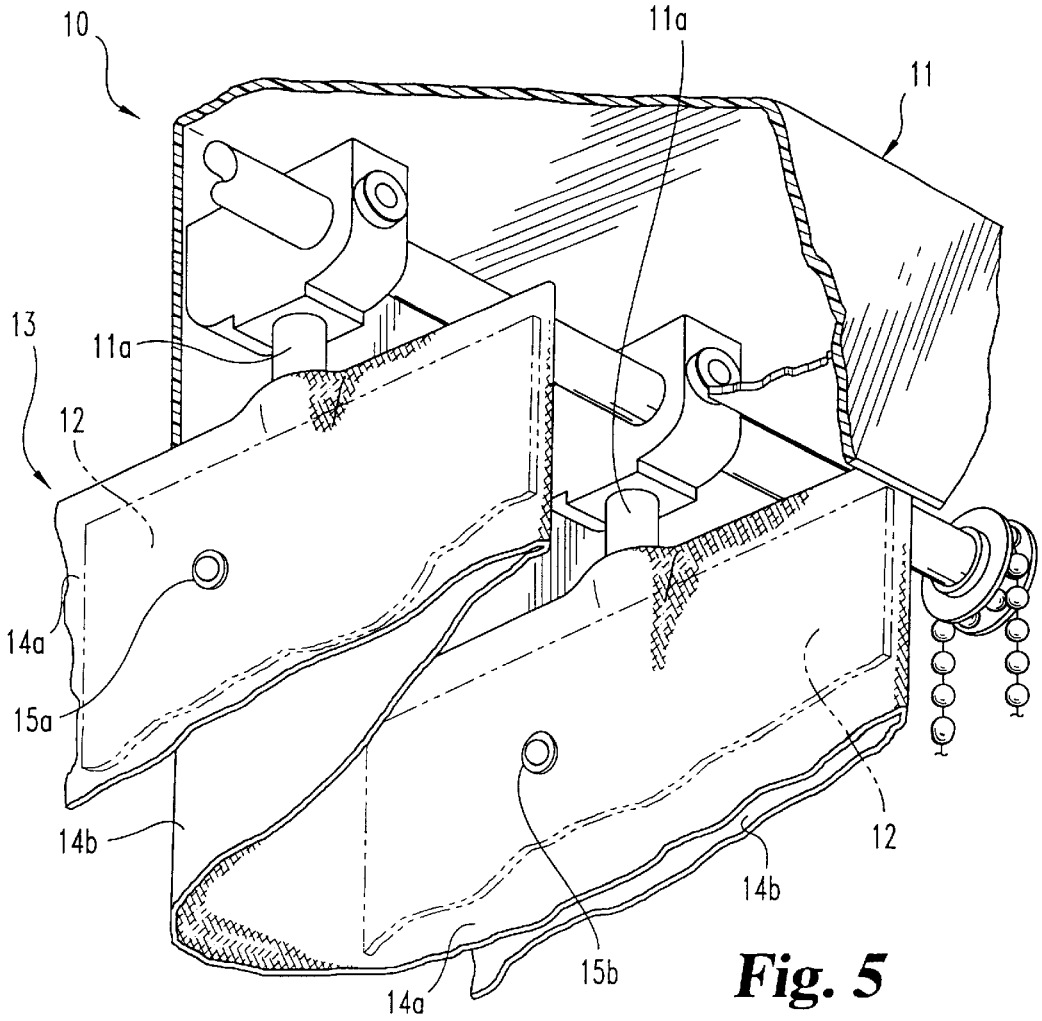
FIG. 5 is a fragmented lower left front perspective view of the upper right portion of the blind system of the invention which incorporates the blind vanes and cover of FIGS. 1–4, illustrating the mechanism to rotate the vanes about a vertical axis.

Referring now to FIGS. 1–4, four (4) vertical blind vanes 12 in accordance with the present invention are shown detached from a blind vane mechanism 11 shown in FIG. 5, and a blind vane cover 13 in accordance with the present invention is shown. The blind vane cover is preferably a white sheer fabric material, but may alternatively be any other color sheer fabric material, or any other sheet, lace or other non-sheer fabric material. Each blind vane 12 has a hole 12*a* as best shown in FIG. 1. Preferably, each blind vane 12 has one circular hole 12*a*, but it could have more, for use with additional connectors. It is further preferred that holes 12*a* are located near the top of blind vanes 12. While the holes 12*a* could be centered, they are preferably modestly offset from the vertical axis of rotation, so that the majority of the vanes 12 have the cover 13 wrapped about it, abutting it. While the hole is completely encircled, the hole could alternatively also be in a form of a notch, near the top of the blind vane.

Blind vane cover 13 includes a plurality of folded panels 14 sequentially adjoined together. Each panel 14 has a left section 14*a* and a right section 14*b* as best shown in FIG. 4 defining a pocket 14*c* as best shown in FIG. 1 for receiving one of the blind vanes 12 as best shown in FIG. 4. The present invention contemplates that panels 14 can have any configuration and dimensions, and can be made from any suitable material. The present invention further contemplates that the configuration, dimensions, and material for a particular panel 14 can vary from the configuration, dimensions, and material of one or more of the other panels 14. It is preferred that all panels 14 have about the same configuration as blind vanes 12, and that the dimensions of left sections 14*a* and right sections 14*b* of the panels 14 enable the majority of the blind vanes 12 to be within pockets 14*c* as best shown in FIG. 4. It is further preferred that an upper end of panels 14 are folded over upon itself and stitched along its entire length to provide a hem 14*d*, that a lower end of panels 14 are folded over upon itself and stitched along its entire length to provide a hem 14*e*, and that the end panels have a free side folded over upon itself and stitched along at its upper and lower ends to define slots 14*f* as best shown in FIG. 4 to receive an end blind vane 12.

Blind vane cover 13 includes a pair of complementary fasteners adjoined to the upper ends of opposite sides of each of the panels 14 to thereby removably mount blind vane cover 13 to blind vanes 12, through holes 12*a*. While various complementary fasteners may be selected, preferably the pairs of complementary fasteners are a female snap member 15*a* and a male snap member 15*b* as best shown in FIG. 1. It is preferred that female snap members 15*a* are adjoined to left sections 14*a* along hem 14*d* and face pockets 14*c*, and male snap members 15*b* are adjoined to right sections 14*b* along hem 14*d* and face pockets 14*c*, with the snap members 15*a* and 15*b* being positioned to maintain a relatively close abutting wrap of the upper ends of panels 14 around vanes 12, as best shown in FIG. 4.

Blind vane cover 13 further includes tie tacks 16 adjoined to the lower ends of opposite sides of each of the panels 14 to thereby abut the lower ends of panels 14 around vanes 12 as best shown in FIG. 3. Each tie tack 16 has a left end 16*a* extending through left sections 14*a* of panels 14, a right end 16*b* extending through right sections 14*b* of panels 14, and a band 16*c* adjoined to left end 16*a* and right end 16*b*. Preferably, bands 16*c* abut an outer edge of vanes 12 as best shown in FIG. 4.

There is shown the preferred single pair of snap members for each vane, offset from the center of vane rotation, where sheer fabric panels are used with conventional sized vanes. However, as an alternative example, for heavy fabric or large vanes, more than one snap pair may be used, with additional holes being added through the vanes for passage of the coupled snap pairs. It is preferred that male snap members 15*b* extend through holes 12*a* as best shown in FIG. 4. It is to be appreciated that a person can readily grab the adjacent cover portions adjoining two consecutive panels 14 to pull the snap members 15*a* and 15*b* apart to thereby dismount blind vane cover 13 from blind vanes 12 and convert the FIG. 4 arrangement to the FIG. 1 dismounted form. By doing so, the cover can be readily laundered or repaired, and replaced by simply sliding vanes 12 within pockets 14*c* over tie tacks 16, and re-snapping the snap members 15*a* and 15*b* through the holes 12*a*.

Referring to FIG. 5, a representative portion of the vertical blind system 10 in accordance with the present invention is shown. Vertical blind system 10 includes blind vane mechanism 11, blind vanes 12, and blind vane cover 13. The upper ends of blind vanes 12 are coupled to blind vane mechanism 11 via mounting members 11*a* to vertically and downwardly extend from blind vane mechanism 11. Blind vane cover 13 is removably mounted to blind vanes 12 as previously described herein in connection with FIGS. 1–4. The vertical blind mechanism 11 allows rotation of the vertical vanes 12 about a vertical axis passing through the vanes 12 and their mounting members 11*a*.

While the present invention has been illustrated and described in detail in the drawings and foregoing description, the same is to be considered as illustrative and not restrictive in character, it being understood that the preferred embodiment has been shown and described and that all changes and further modifications that come within the spirit of the present invention are desired to be protected.

What is claimed is:

1. A vertical blind system comprising:

a vertical blind vane mechanism;

a plurality of vertical blind vanes coupled to said blind vane mechanism, said plurality of blind vanes each having a first hole therethrough near a top of said plurality of blind vanes; and a blind vane cover including a plurality of folded panels, each of said plurality of folded panels defining a pocket, each of said pockets having one vertical blind vane of said plurality of blind vanes being disposed, respectively, within said pocket, and a pair of complementary readily disengageable fasteners adjoined to said blind vane cover of said pocket, wherein a first fastener member of said pair of fasteners is disposed within said hole of said one blind vane, and wherein a second fastener member of said pair of fasteners is detachably coupled to said first fastener member of said pair of fasteners to thereby mount said panel to said plurality of blind vanes in a readily removable manner; and said blind vane cover near the top of said plurality of blind vanes extending between adjacent vanes in a U-shape, with each leg of the U being near a respective one of the adjacent vanes, and the base of the U extending between the adjacent vanes near the vertical edges of the adjacent vanes that are opposite the closed ends of said pockets.

2. The vertical blind system of claim 1 wherein each of said pairs of complementary readily disengageable fasteners are snaps.

3. The vertical blind system of claim 2 wherein said pairs of complementary fasteners include both a male snap and a female snap.

4. The vertical blind system of claim 3 wherein said male snap passes through said hole in said one vertical blind vane.

5. The vertical blind system of claim 1 wherein said hole in each of said plurality of blind vanes is offset from a vertical center line of each of said plurality of blind vanes.

6. The vertical blind system of claim 1 wherein the vertical blind mechanism allows rotation of said plurality of blind vanes about a vertical axis passing through said plurality of blind vanes.

7. The vertical blind system of claim 1 wherein said blind vane cover pocket is substantially abutting said one vertical blind vane over half of a width of said one vertical blind vane.

8. The vertical blind system of claim 1 wherein said blind vane cover additionally has an end slot for enclosing one vertical edge of a last one of said plurality of vanes.

9. The vertical blind system of claim 1 wherein said blind vane cover is a sheer fabric material.

10. The vertical blind system of claim 9 wherein said blind vane cover is a white sheer fabric material.

11. The vertical blind system of claim 1 wherein an upper end of said blind vane cover is folded over upon itself and stitched along its entire length to provide a hem.

12. The vertical blind system of claim 1 wherein there are at least 4 vertical blind vanes.

13. The vertical blind system of claim 1 wherein a lower end of said blind vane cover is folded over upon itself and stitched along its entire length to provide a hem.

14. The vertical blind system of claim 1 wherein each of said pockets further has a tie tack, each of said tie tack having a first end extending through a first side of said pockets, a second end extending through a second side of said pockets, and a band adjoined to said first end and to said second end.

15. A vertical blind system comprising:

a vertical blind vane mechanism;

several vertical blind vanes coupled to said blind vane mechanism, one vane of said several vanes having a hole therethrough near the top of said one vane; and a blind vane cover including a folded panel defining a pocket, said pocket having said one vane of said several vanes being disposed, respectively, within said pocket, a pair of complementary readily disengageable fasteners adjoined to said blind vane cover of said pocket, wherein a first fastener member of said pair of fasteners is disposed within said hole of said one vane of said several vanes, and wherein a second fastener member of said pair of fasteners is detachably coupled to said first fastener member of said pair of fasteners to thereby mount said panel to said one vane of said several vanes in a readily removable manner; and said blind vane cover near the top of said several vanes extending between adjacent vanes in a U-shape, with each leg of the U being near a respective one of the adjacent vanes, and the base of the U extending between the adjacent vanes near the vertical edges of the adjacent vanes that are opposite the closed ends of said pockets.

16. The vertical blind system of claim 15 wherein said pair of complementary readily disengageable fasteners are snaps.

17. The vertical blind system of claim 15 wherein said pair of complementary fasteners include both a male snap and a female snap.

18. The vertical blind system of claim 17 wherein said male snap passes through said hole in said one vane.

19. The vertical blind system of claim 15 wherein said hole in each of several vanes is offset from a vertical center line of each of said several vanes.

20. The vertical blind system of claim 15 wherein the vertical blind mechanism allows rotation of said several vanes about a vertical axis passing through said several vanes.

21. The vertical blind system of claim 15 wherein said blind vane cover pocket is substantially abutting said one vane over half of a width of said one vane.

22. The vertical blind system of claim 15 wherein said blind vane cover additionally has an end slot for enclosing one vertical edge of a last one of said several vanes.

23. The vertical blind system of claim 15 wherein said blind vane cover is a sheer fabric material.

24. The vertical blind system of claim 23 wherein said blind vane cover is a white sheer fabric material.

25. The vertical blind system of claim 15 wherein an upper end of said blind vane cover is folded over upon itself and stitched along its entire length to provide a hem.

26. The vertical blind system of claim 15 wherein there are at least 4 vertical blind vanes.

27. The vertical blind system of claim 15 wherein a lower end of said blind vane cover is folded over upon itself and stitched along its entire length to provide a hem.

28. The vertical blind system of claim 15 wherein said pocket further has a tie tack, said tie tack having a first end extending through a first side of said pockets, a second end extending through a second side of said pockets, and a band adjoined to said first end and to said second end.

* * * * *